US006489000B1

(12) United States Patent
Ogura et al.

(10) Patent No.: US 6,489,000 B1
(45) Date of Patent: Dec. 3, 2002

(54) CUSHION HAVING A THREE-DIMENSIONAL NET

(75) Inventors: Yumi Ogura, Hiroshima (JP); Etsunori Fujita, Hiroshima (JP); Kazuyoshi Chizuka, Hiroshima (JP); Masaki Nishino, Hiroshima (JP); Seiji Kawasaki, Hiroshima (JP)

(73) Assignee: Delta Tooling Co., Ltd., Hiroshima (JP)

( * ) Notice: Subject to any disclaimer, the term of this patent is extended or adjusted under 35 U.S.C. 154(b) by 0 days.

(21) Appl. No.: 09/526,481

(22) Filed: Mar. 15, 2000

(30) Foreign Application Priority Data

Mar. 16, 1999 (JP) ..... 11-070285

(51) Int. Cl.[7] ..... B32B 3/02; A47C 20/08; B68B 1/04

(52) U.S. Cl. ..... 428/45; 5/636; 5/411; 5/498; 5/496; 54/17; 54/61

(58) Field of Search ..... 5/636, 411, 498, 5/496; 74/583; 54/17, 61; 402/26; 38/140; 2/263; 24/713.9, 8; 297/452.48, 452.16; 131/173; 249/1; 425/11; 29/527.1; 264/271.1

(56) References Cited

U.S. PATENT DOCUMENTS

| | | | | |
|---|---|---|---|---|
| 2,792,875 A | * | 5/1957 | Pirrone | 155/33 |
| 3,359,610 A | | 12/1967 | Faircloth | |
| 5,390,572 A | * | 2/1995 | Gakhar et al. | 81/436 |

FOREIGN PATENT DOCUMENTS

| | | | |
|---|---|---|---|
| DE | 216314 | * | 11/1909 |
| EP | 0 685 882 A1 | | 12/1995 |
| TW | 210466 | | 8/1993 |

* cited by examiner

*Primary Examiner*—Elizabeth M. Cole
*Assistant Examiner*—Alexis Wachtel
(74) *Attorney, Agent, or Firm*—Wenderoth, Lind & Ponack, L.L.P.

(57) ABSTRACT

A cushion includes a three-dimensional net, a plurality of metallic fastening members attached to the three-dimensional net on opposite sides thereof, and two resinous frames attached to the opposite sides of the three-dimensional net, respectively. The metallic fastening members are sandwiched between the resinous frames and the opposite sides of the three-dimensional net, and the resinous frames together with the metallic fastening members are joined to the three-dimensional net by vibration welding.

21 Claims, 13 Drawing Sheets

CUSHION HAVING A THREE-DIMENSIONAL NET

BACKGROUND OF THE INVENTION

1. Field of the Invention

The present invention relates to an air-permeable cushion having a three-dimensional net and suited for use in seats, beds or the like.

2. Description of the Related Art

Conventional seats or beds generally include a pad material placed on a frame and covered with a skin, and some of them also include spring members for enhancing the cushioning characteristics. Such seats or beds still involve room for improvement in air permeability or in heat-radiating properties, and they are mostly thick, heavy and costly.

Recently, a relatively light net-shaped cushion structure having a superior air permeability has been proposed.

Such a net-shaped cushion structure can be used for a cushioning member such, for example, as a floor cushion only by treating side edges thereof. It can be also used for a seat cushion by fitting anchoring members thereto after the side edge treatment and by engaging the anchoring members with a frame of a seat.

However, where the net-shaped cushion structure is used for the seat cushion, relatively large molded articles made by an injection method are generally used for the anchoring members. Accordingly, a relatively large molding machine is needed, resulting in an increase in initial cost.

SUMMARY OF THE INVENTION

The present invention has been developed to overcome the above-described disadvantages.

It is accordingly an objective of the present invention to provide an inexpensive cushion having a three-dimensional net that has a superior durability and can be readily and positively mounted to a seat frame or the like.

In accomplishing the above and other objectives, the cushion according to the present invention includes a three-dimensional net, a plurality of metallic fastening members attached to the three-dimensional net on opposite sides thereof, and two resinous frames attached to the opposite sides of the three-dimensional net, respectively. The plurality of metallic fastening members are sandwiched between the two resinous frames and the opposite sides of the three-dimensional net, and the two resinous frames together with the plurality of metallic fastening members are joined to the three-dimensional net by vibration welding.

This construction enables the three-dimensional net to be positively secured to, for example, a seat frame with the use of the fastening members, resulting in an increase in durability. Both the fastening members and the resinous frames are relatively inexpensive, and the fastening members can be readily attached to the seat frame. Furthermore, the metallic fastening members, which cannot be solely welded to the three-dimensional net, can be secured to the side portions of the three-dimensional net by making use of the resinous frames, making it possible to provide an inexpensive cushion.

Advantageously, each of the plurality of metallic fastening members has a recess formed at a welded portion on each side thereof. This recess acts to increase the joining strength obtained by the vibration welding, resulting in an increase in durability.

Again advantageously, each of the plurality of metallic fastening members has a plurality of projections formed therewith along the recess, and at least one of them is bent at right angles so as to bite into the resinous frame, thereby facilitating the positioning of the fastening members and increasing the joining strength.

Conveniently, the cushion further includes at least one belt attached to the three-dimensional net. Not only the weight of a cushion occupant but a load inputted to the cushion from outside can be supported by both the three-dimensional net and the belt, thus further increasing the durability.

BRIEF DESCRIPTION OF THE DRAWINGS

The above and other objectives and features of the present invention will become more apparent from the following description of preferred embodiments thereof with reference to the accompanying drawings, throughout which like parts are designated by like reference numerals, and wherein.

DETAILED DESCRIPTION OF THE PREFERRED EMBODIMENTS

This application is based on application No. 11-70285 filed Mar. 16, 1999 in Japan, the content of which is incorporated hereinto by reference.

Figure 1:
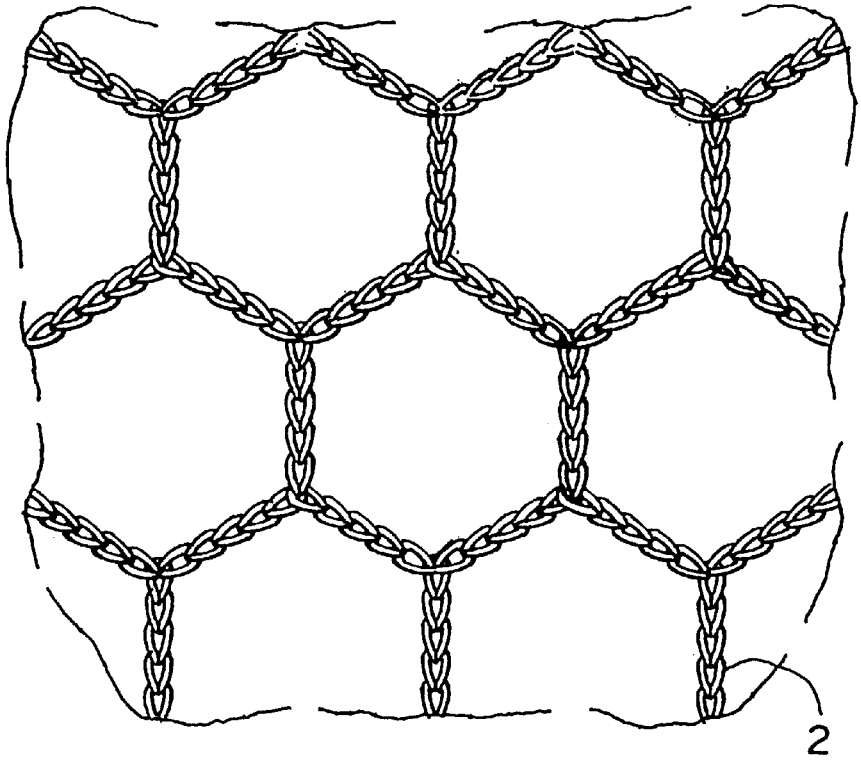
FIG. 1 is a fragmentary front view, on an enlarged scale, of a three-dimensional net for a cushion according to the present invention.
Figure 2:
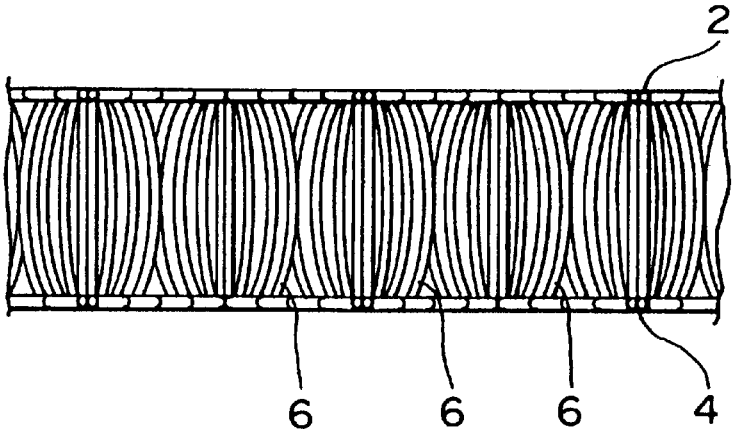
FIG. 2 is a fragmentary side view of the three-dimensional net of FIG. 1.

FIGS. 1 and 2 depict a three-dimensional mesh knit forming a three-dimensional net (hereinafter referred to as a 3-D net) 8. A fabric base is formed into a honeycomb-shaped (hexagonal) mesh. The mesh knit is of a three-layered solid truss structure in which an upper mesh layer 2 and a lower mesh layer 4 are connected to each other by a pile layer having a large number of piles 6.

Each yarn of the upper mesh layer 2 and the lower mesh layer 4 is formed by twisting a number of fine threads, while each of the piles 6 is formed of a single thick string to provide the three-dimensional mesh knit with rigidity.

Table 1 shows physical values of various materials used for the upper mesh layer 2, the lower mesh layer 4, and the piles 6 forming the pile layer.

other as viewed from above, while "cross" means that they deviate from each other.

Thermoplastic resins are preferably used as the material of the three-dimensional mesh knit, and it is sufficient if the material can be formed into fibers. When textiles are made of such material, it is sufficient if it provides a strength required for a sheet stock. Typical examples are thermoplastic polyester resins such as polyethylene terephthalate (PET), polybutylene terephthalate (PBT), etc., polyamide resins such as nylon 6, nylon 66, etc., polyolefin resins such as polyethylene, polypropylene, etc., and resins in which more than two kinds of such resins are mixed.

The fiber thickness of each pile 6 is greater than 380 d and, preferably, greater than 600 d so that the load of a seat occupant applied to the three-dimensional mesh knit can be supported by deformation of the hexagonal meshes and by inclination of the piles, thereby providing a soft structure that causes no stress concentration.

Figure 3A:
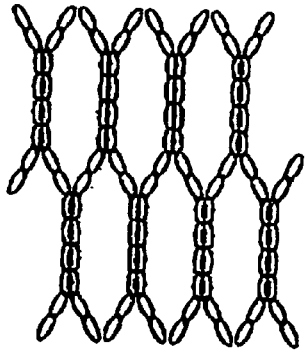
FIG. 3A is a schematic view of a fabric base texture used for upper and lower mesh layers of the three-dimensional net, particularly depicting a honeycomb-shaped (hexagonal) mesh shown in FIG. 1.
Figure 3B:
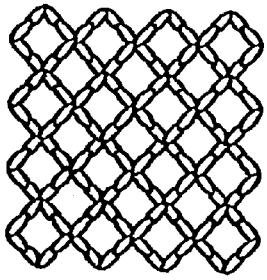
FIG. 3B is a: view similar to FIG. 3A, but particularly depicting a diamond-shaped mesh.
Figure 3C:
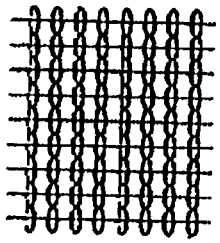
FIG. 3C is a view similar to FIG. 3A, but particularly depicting a chain-inserted texture.

FIGS. 3A to 3C schematically depict several fabric base textures used for the upper and lower mesh layers 2, 4. In particular, FIG. 3A depicts a honeycomb-shaped (hexagonal) mesh shown in FIG. 1, FIG. 3B a diamond-shaped mesh, and FIG. 3C a chain-inserted texture.

TABLE 1

| Item | | Item No. | | | | | |
|---|---|---|---|---|---|---|---|
| | | D80032C | D80050 | D80052 | D80052-B | D80055 | D80053 |
| Material | | Polypropylene | Polyester *A | ← | Polyester | ← | Polyester *A |
| Weight g/m$^2$ | | 663 | 480 | 483 | 496 | 481.6 | 454.4 |
| Density | warp/inch | 7 | 5 | 5 | 6 | 6 | 6 |
| | weft/inch | 14 | 15 | 15 | 15 | 15 | 14 |
| Fiber Thickness (d/f) | ground | 210d/60f | 150d/48f | ← | ← | 250d/48f | 150d/48f |
| | pile | 380d/1f *double | 600d/1f black | ← | 600d/1f | ← | 600d/1f black |
| Pull Strength (kg/5 cm) | warp | 41.9 | 10.8 | 10.2 | 15.1 | 29.0 | 11.2 |
| | weft | 20.0 | 5.4 | 6.6 | 6.98 | 14.2 | 9.0 |
| Elongation (%) | warp | 49.5 | 50.4 | 49.5 | 34.2 | 37.7 | 61.7 |
| | weft | 178.0 | 126.2 | 114.1 | 153.8 | 134.4 | 71.0 |
| Pile Texture | | cross | straight | cross | cross | cross | cross |

Figure 4A:
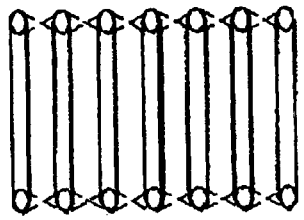
FIG. 4A is a schematic view of a pile texture connecting the upper and lower mesh layers, particularly depicting a generally straight texture corresponding to FIG. 2.
Figure 4B:
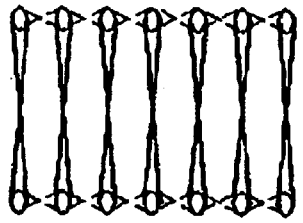
FIG. 4B is a view similar to FIG. 4A, but particularly depicting a generally straight texture in the form of a figure "8"
Figure 4C:
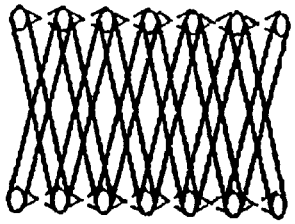
FIG. 4C is a view similar to FIG. 4A, but particularly depicting a cross texture.
Figure 4D:
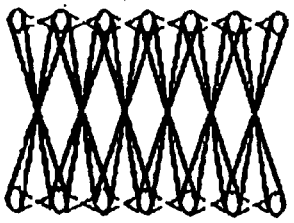
FIG. 4D is a view similar to FIG. 4A, but particularly depicting a cross texture in the form of a figure "8"

In Table 1, "*A" means that the material was colored to black. Character d represents a denier, and 1 d is a unit of thickness when 1 gram of thread has been pulled by 9,000 meters. 210 d is a thickness when 1 gram of thread has been pulled by 9,000/210=42.9 meters. Character f represents a filament that is a unit indicating the number of fine threads forming a yarn, and 60*f* means that a yarn is made of 60 fine threads. The pulling strength "kg/5 cm" is a strength when a mesh having a width of 5 cm has been pulled in the longitudinal direction. Furthermore, "straight" in the pile texture means that hexagons of the upper mesh layer 2 and those of the lower mesh layer 4 completely overlap each FIGS. 4A to 4D schematically depict several pile textures connecting the upper and lower mesh layers 2, 4. In particular, FIG. 4A depicts a generally straight texture corresponding to FIG. 2, FIG. 4B a generally straight texture in the form of a figure "8", FIG. 4C a cross texture, and FIG. 4D a cross texture in the form of a figure "8".

Table 2 shows physical values of the material used for the upper mesh layer 2, the lower mesh layer 4 and the piles 6 forming the pile layer, and those of other various materials.

TABLE 2

| Item | | Item No. | | | | | |
|---|---|---|---|---|---|---|---|
| | | 09001-D | 09002D | 09006D | D80053-2 | D90028-5 | 90012-2 |
| Material | | Polyester | ← | ← | ← | ← | ← |
| Weight g/m$^2$ | | 1027 | 1101 | 1280 | 784 | 840 | 648 |
| Density | warp/inch | 7 | 8 | 8 | 7.5 | 10 | 6.0 |
| | weft/inch | 15 | 15 | 14 | 13 | 14 | 14.0 |
| Fiber Thick. (d/f) | ground | 1300d/96f | 1300d196f | 1300d/96f | 1300d/96f | ← | 1300d/96f |
| | | | 500d/70f | | 500d/70f | ← | |

TABLE 2-continued

| Item | | Item No. | | | | | |
|---|---|---|---|---|---|---|---|
| | | 09001-D | 09002D | 09006D | D80053-2 | D90028-5 | 90012-2 |
| | pile | 800d/1f | ← | ← | 600d/1f | ← | 300d/1f |
| Pull Strength | warp | 129.2 | 156.8 | 96.7 | 156.9 | 201.1 | 107.7 |
| (kg/5 cm) | weft | 89.0 | 68.6 | 143.2 | 62.1 | 121.1 | 85.2 |
| Elongation (%) | warp | 68.2 | 70.0 | 73.1 | 56.2 | 47.9 | 39.8 |
| | weft | 98.4 | 96.6 | 65.0 | 66.4 | 102.8 | 102.6 |
| Tear Strength (kg) | warp | 87.5 | 96.2 | 87.0 | 87.9 | 99.9 | 72.7 |
| | weft | 63.7 | 54.8 | 82.5 | 49.2 | 70.3 | 56.1 |
| Load (*1) | thick. mm | 11.1 | 11.7 | 12.3 | — | — | — |
| 200 g/cm$^2$ | compress. % | 16.2 | 13.3 | 11.6 | — | — | — |
| Ordinary State | elasticity % | 92.6 | 91.3 | 89.9 | — | — | — |
| Strain After | warp | 2.8 | 1.6 | 2.5 | 2.6 | 2.3 | 3.0 |
| Repeated Load (%) | weft | 2.0 | 5.2 | 1.8 | 10.6 | 10.6 | 31.0 |
| Surface Wearability | warp | 4.5 | 3.5 | 4 | 4.5 | 4.5 | 4.5 |
| Grade | weft | 4 | 3.5 | 4 | 4 | 4 | 4 |
| Fastness to Light | 150H | 4.5 | 4.5 | 4.5 | — | — | — |
| Grade | 250H | 4 | 4.5 | — | | | |
| Fastness to | dry cloth | 4.5 | 4.5 | 4.5 | — | — | — |
| Rubbing Grade | wet cloth | 4.5 | 4.5 | 4.5 | | | |

Figure 5:
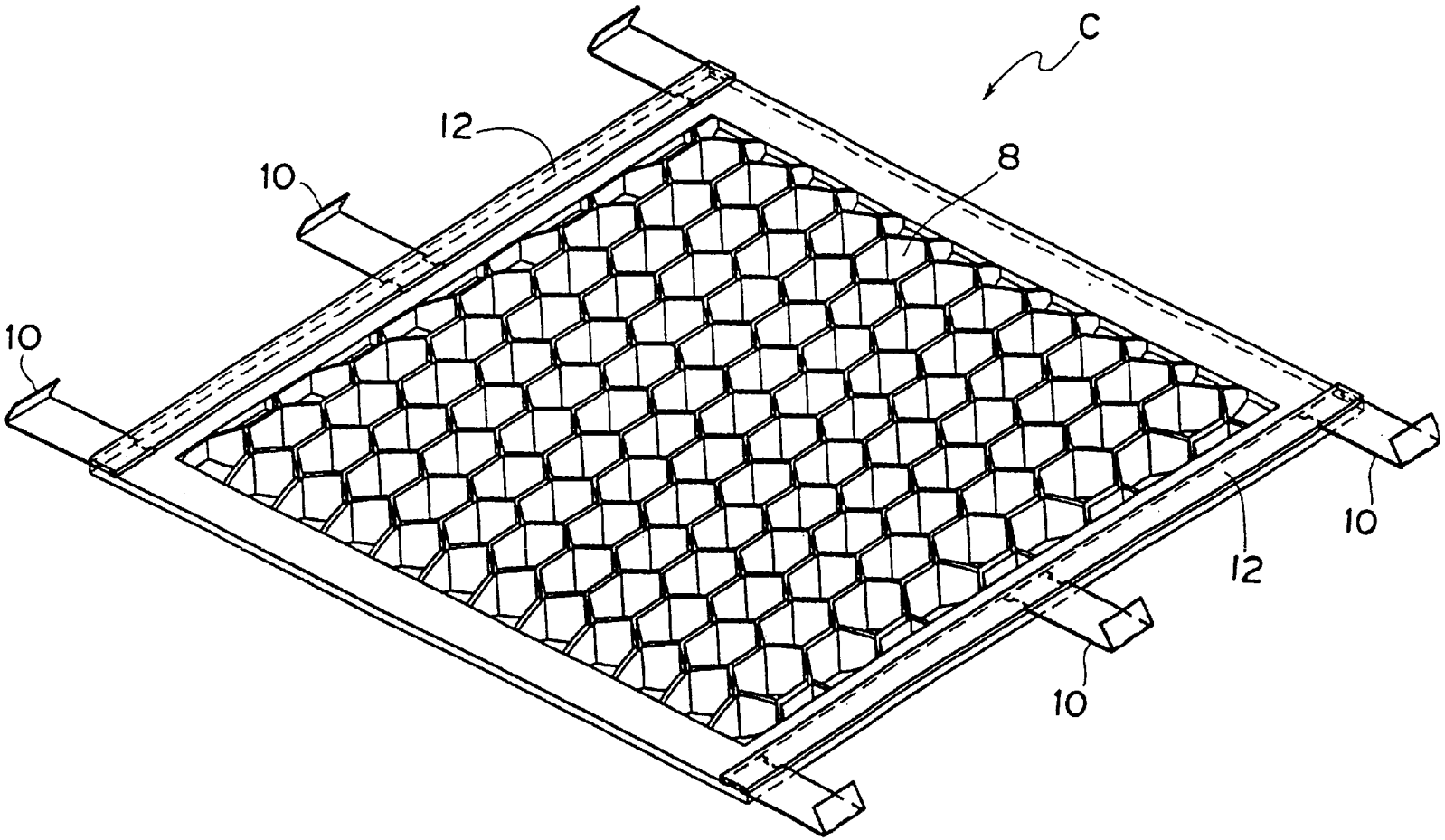
FIG. 5 is a perspective view of a cushion having a three-dimensional net according to the present invention.
Figure 6:
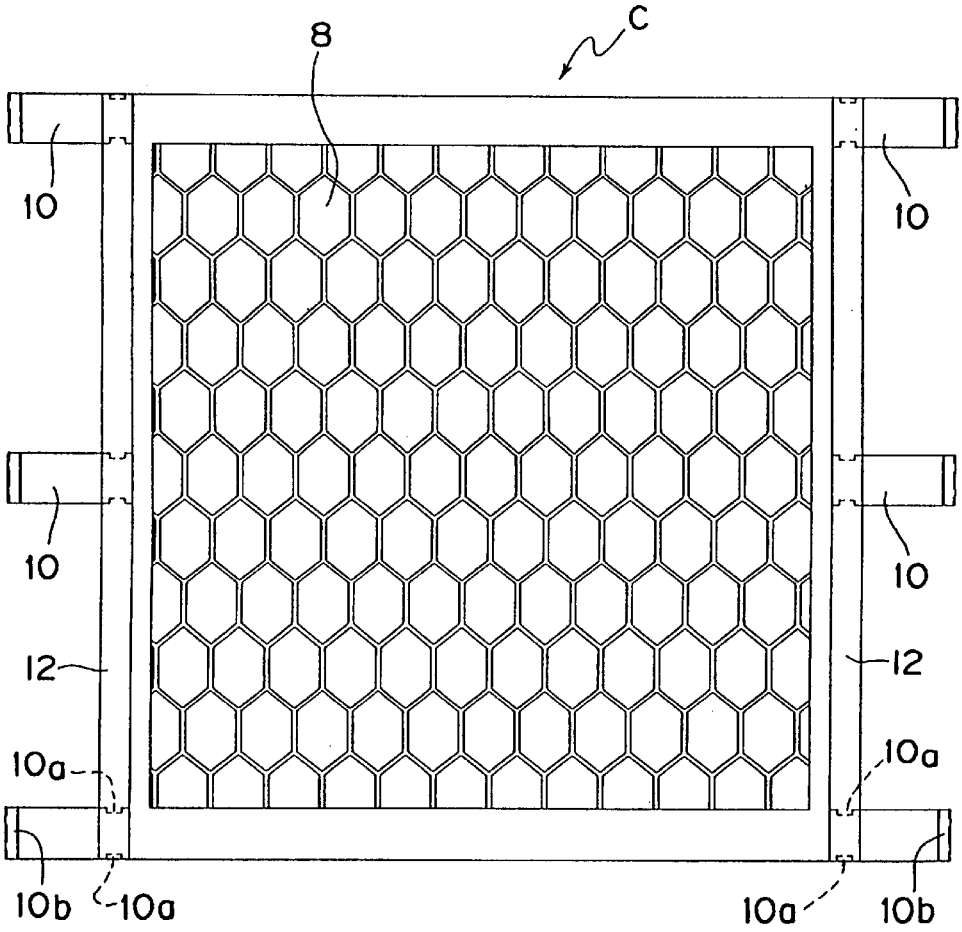
FIG. 6 is a top plan view of the cushion of FIG. 5.
Figure 7:
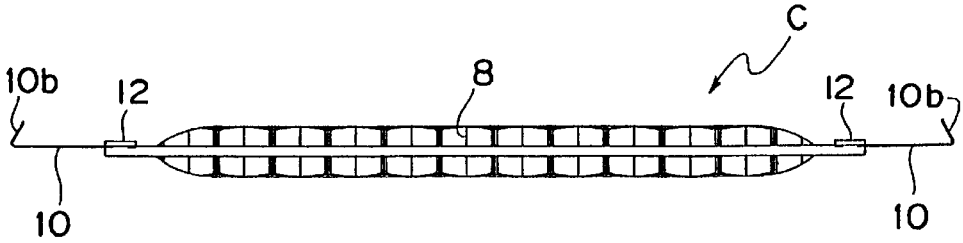
FIG. 7 is a side view of the cushion of FIG. 5.

Remarks (*1):
Sample Size: 50 × 50 mm
Loading Time: 10 minutes
Shelf Time: 10 minutes FIGS. 5 to 7 depict a cushion C according to the present invention, which is used for a seat cushion or a seat back of a wheelchair. The cushion C includes a generally rectangular 3-D net 8 and a plurality of metallic hooks 10 attached to the 3-D net 8 on opposite sides thereof for fastening the 3-D net 8 to a vehicle body.

After the entire outer periphery of the 3-D net 8 has been crushed or thinned by vibration welding, ends of the hooks 10 are sandwiched between each side portion of the 3-D net 8 and an elongated resinous frame 12 at regular intervals, and the resinous frame 12 together with the hooks 10 is joined to the 3-D net 8 by vibration welding again. A thermoplastic resin such as polybutylene terephthalate (PBT) or the like is preferably used for the resinous frame 12.

Each hook 10 has a generally rectangular recess 10*a* formed on each side of the welded end thereof. The recess 10*a* acts to enhance the joining strength of the hook 10 to the 3-D net 8. Each hook 10 also has a bent engaging portion 10*b* formed at a free end thereof opposite to the welded end.

Figure 8:
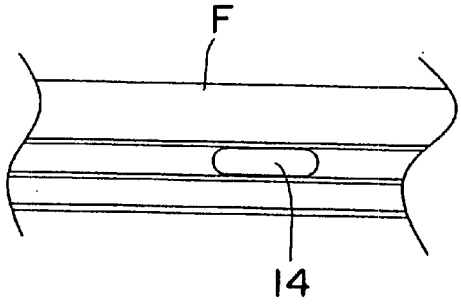
FIG. 8 is a fragmentary side view of a seat frame to which the cushion of FIG. 5 is mounted.
Figure 9:
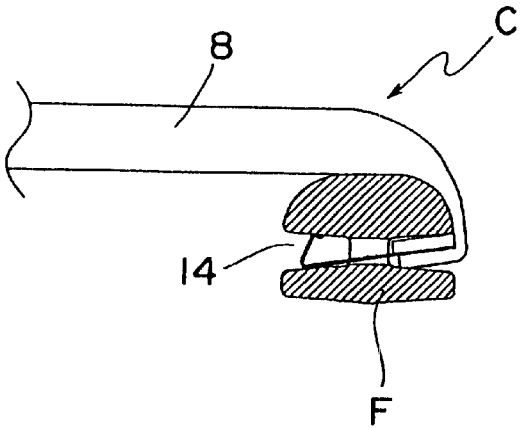
FIG. 9 is a sectional view of the seat frame to which hooks for fastening the cushion of FIG. 5 have been attached.

As shown in FIGS. 8 and 9, a frame F of the vehicle body has a plurality of openings 14 defined therein at regular intervals. When each hook 10 on the cushion C is inserted into one of the openings 14 while a predetermined tension is being applied to the 3-D net 8 by spreading the cushion C in the widthwise direction, the engaging portion 10*b* of the hook 10 is engaged with the internal surface of the opening 14, making it possible to fasten the side portions of the cushion C on the frame F.

Figure 10:
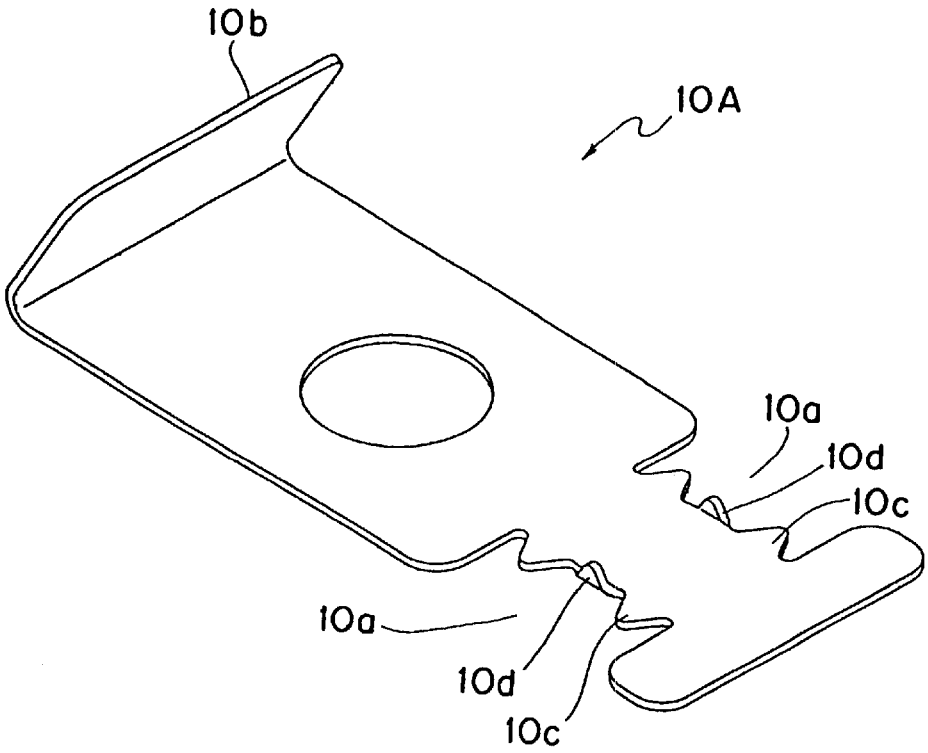
FIG. 10 is a perspective view of one of the hooks.

FIG. 10 depicts a modification 10A of the hook 10. This hook 10A has a plurality of projections 10*c* formed therewith along the generally rectangular recesses 10*a*. One of the projections 10*c* on each side of the hook 10A are bent at right angles relative to the body of the hook 10A. Because the bent projections 10*d* bite into the resinous frame 12, not only can the plurality of hooks 10A be properly positioned with respect to the resinous frame 12, but the joining strength thereof to the 3-D net 8 can also be increased.

It is to be noted that although the hook 10A is illustrated in FIG. 10 as having one bent projection 10*d* on each side thereof, it may have two or more projections on each side thereof.

Figure 11:
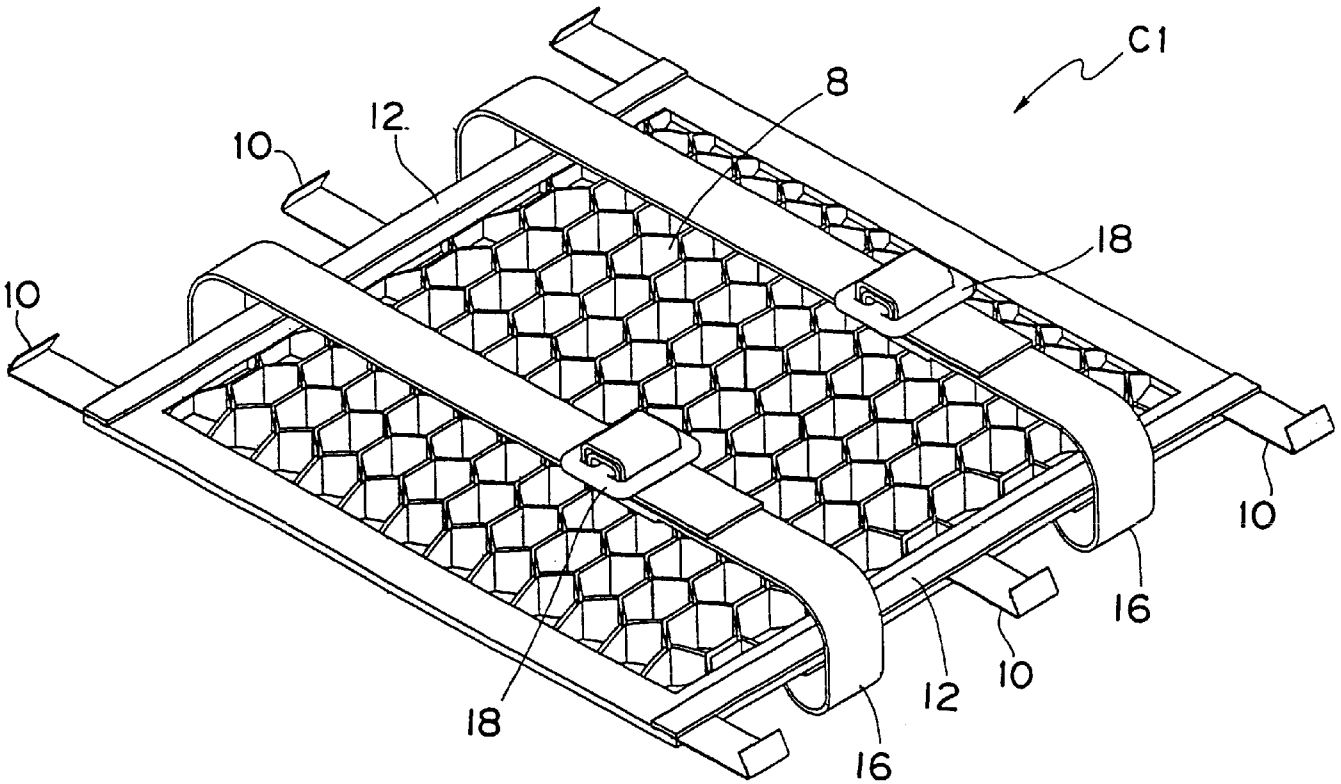
FIG. 11 is a, view similar to FIG. 5, but depicting a modification thereof.
Figure 12:
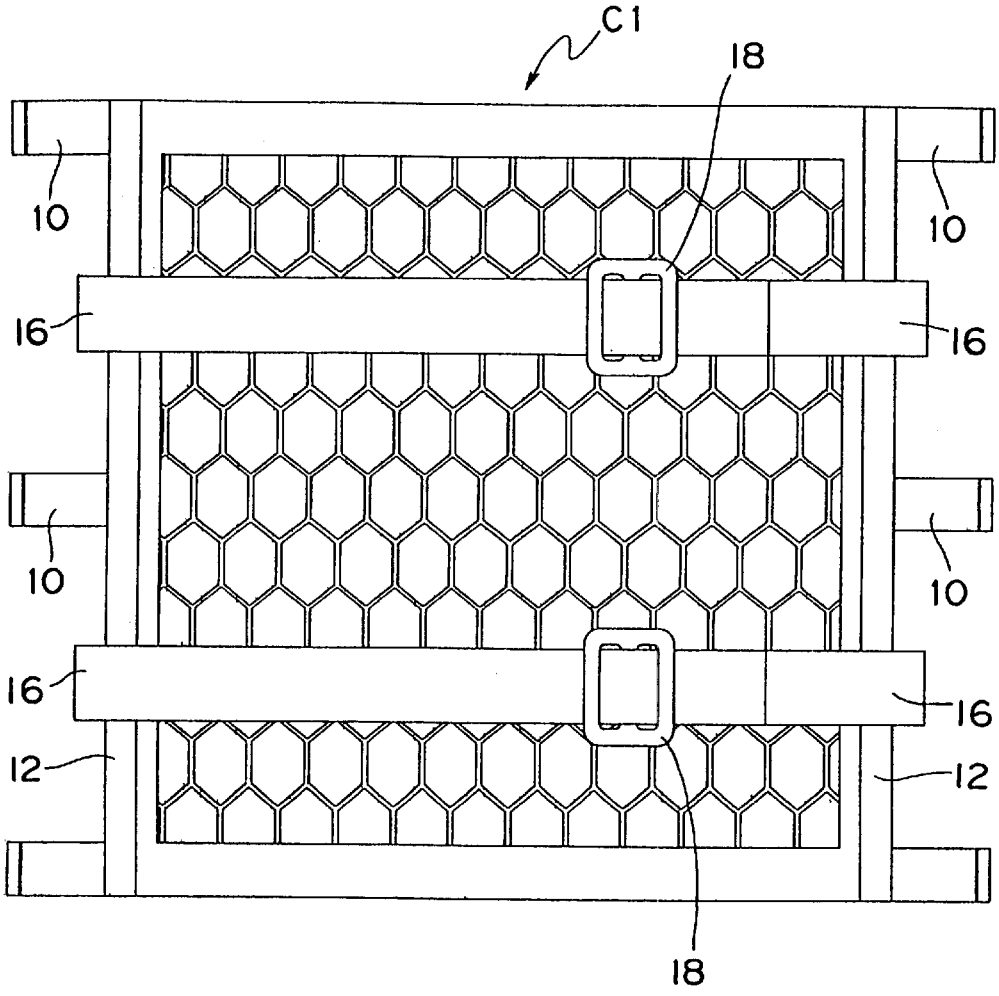
FIG. 12 is a top plan view of the cushion of FIG. 11.
Figure 13:
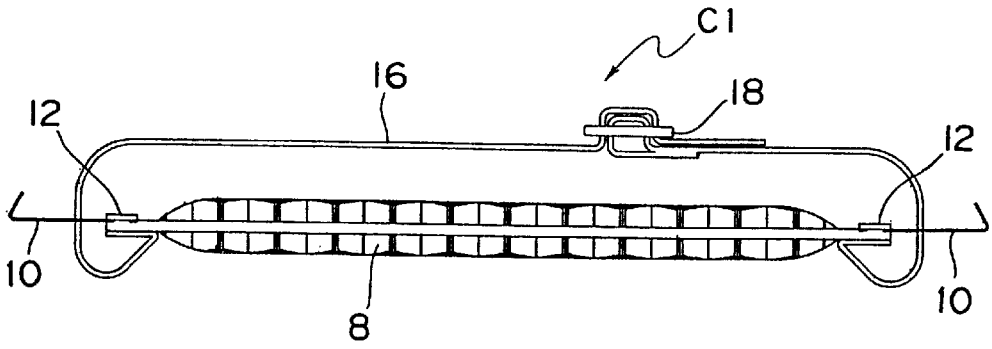
FIG. 13 is a side view of the cushion of FIG. 11.

FIGS. 11 to 13 depict a modification C1 of the cushion, in which two belts 16 are attached to the cushion C shown in FIGS. 5 to 7 at a predetermined interval. Each belt 16 is sewn at opposite ends thereof to the surfaces of respective side portions of the 3-D net 8 opposite to the resinous frames 12. The belt 16 has a buckle 18 attached thereto at an intermediate portion thereof.

Figure 14:
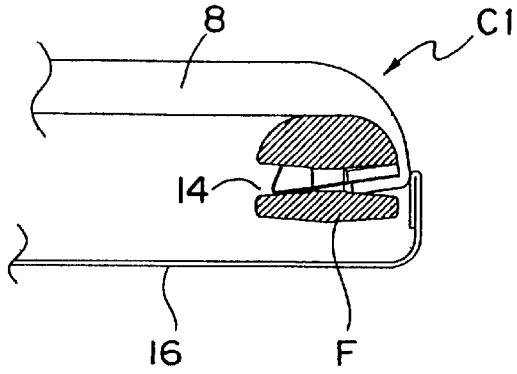
FIG. 14 is a sectional view of a seat frame to which hooks for fastening the cushion of FIG. 11 have been attached.

As shown in FIG. 14, upon placing the 3-D net 8 on the frame F of the vehicle body, the cushion C1 is fastened to the frame F by inserting the hooks 10 into the corresponding openings 14 and then by fastening the belts 16, that have been passed below the frame F, using the buckles 18.

The cushion C1 of the above-described construction can support the weight of a cushion occupant by means of both the 3-D net 8 and the belts 16. Furthermore, if the cushion occupant sinks into the 3-D net 8 when vibration is inputted thereto from outside, the 3-D net 8 pulls the belts 16 inwardly to increase the tensions of the belts 16, and reaction forces from the belts 16 are transmitted to the hip of the cushion occupant. Because the hip of the cushion occupant is brought into and held in contact with the belts 16 via the 3-D net 8, a load greater than the weight of the cushion occupant is supported by the 3-D net 8 and the belts 16. The tensions of the belts 16 also act to prevent the hooks 10 from slipping off the frame F.

It is to be noted that although the two belts 16 are illustrated in FIGS. 11 and 12, only one belt 16 may be attached to the cushion C.

Figure 15:
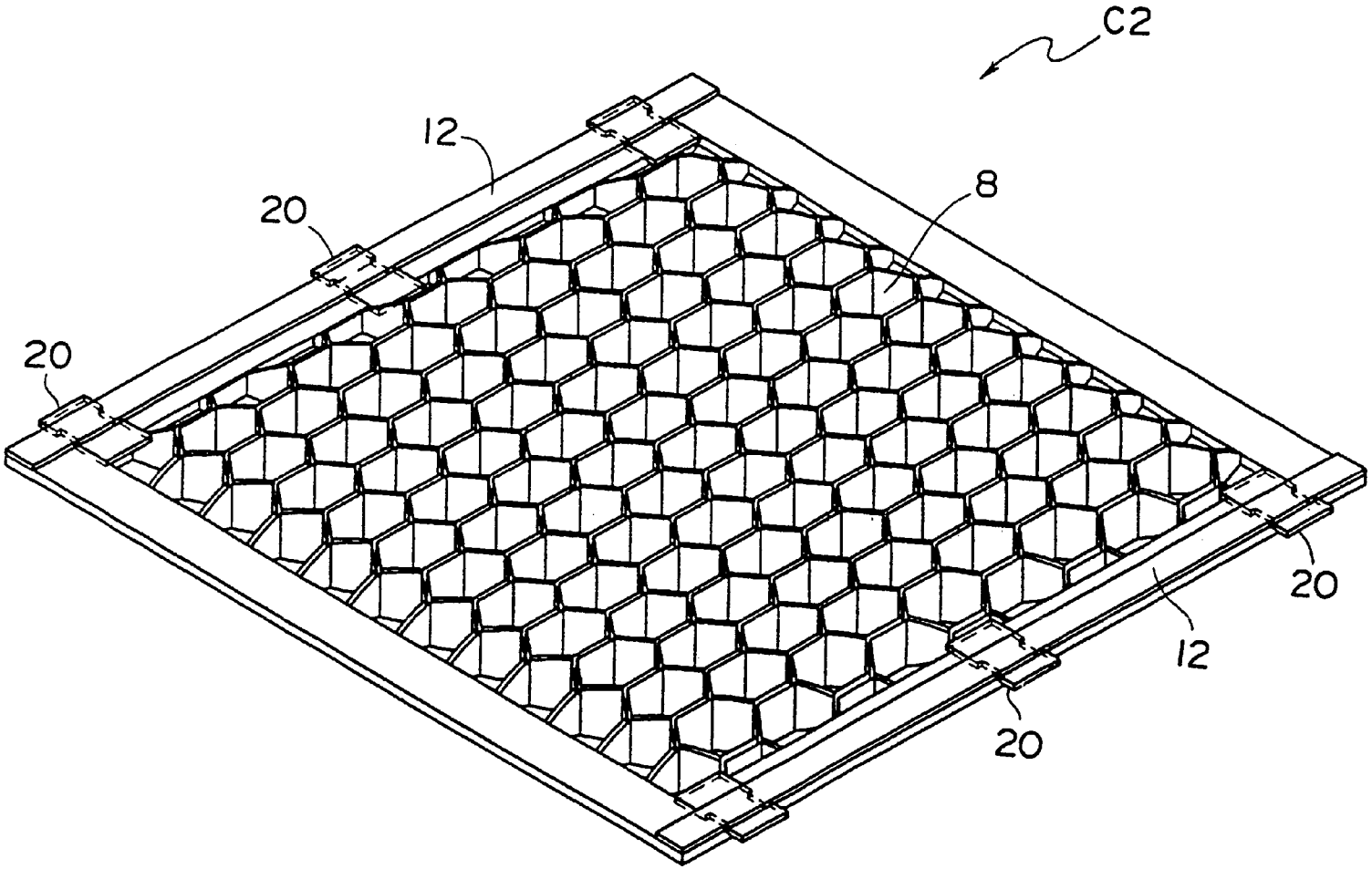
FIG. 15 is a view similar to FIG. 5, but depicting another modification thereof.
Figure 16:
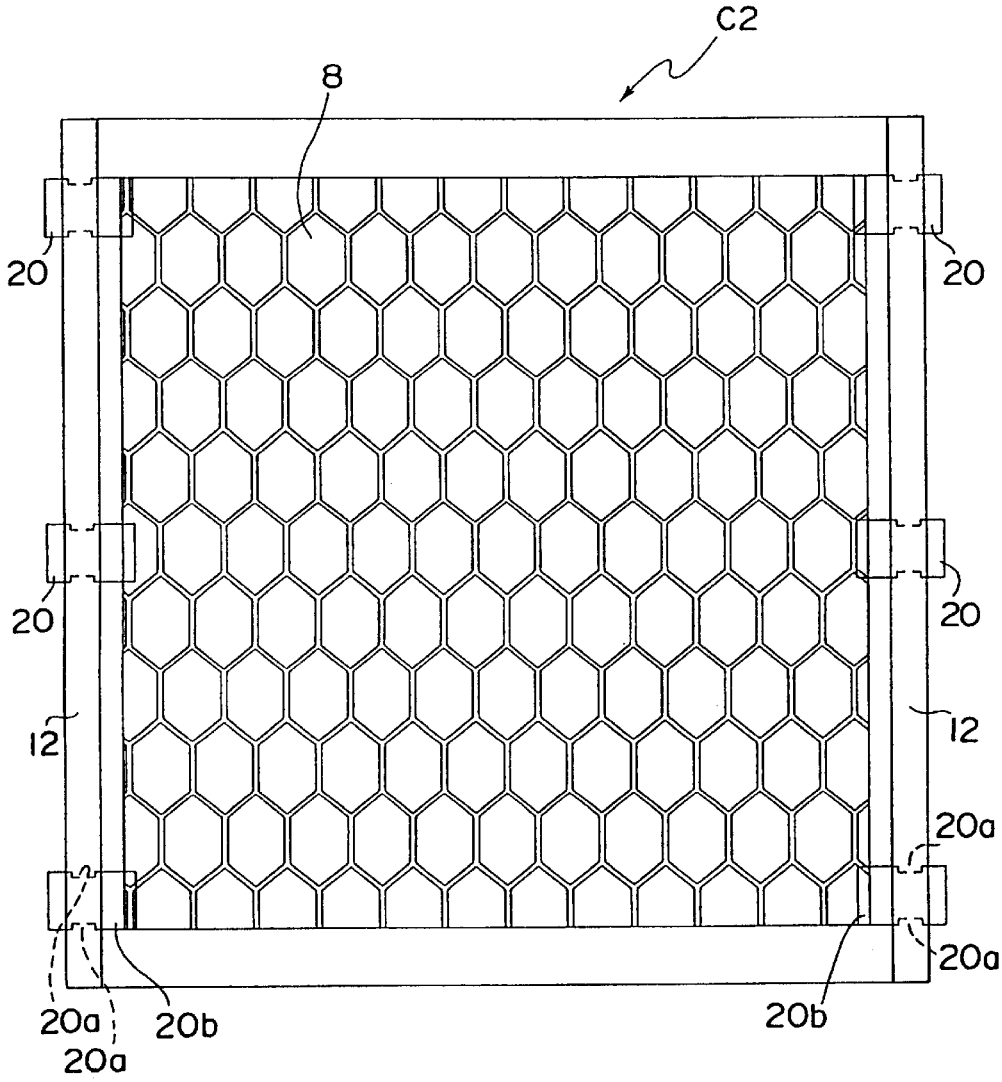
FIG. 16 is a top plan view of the cushion of FIG. 15.
Figure 17:
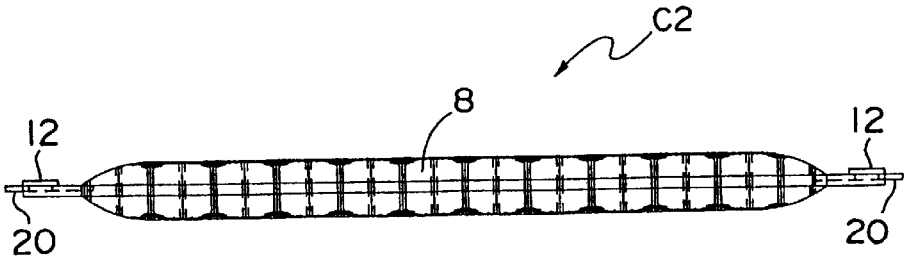
FIG. 17 is a side view of the cushion of FIG. 15.

FIGS. 15 to 17 depict a modification C2 of the cushion. This cushion C2 includes a 3-D net 8 and a plurality of generally flat and metallic anchor plates 20 attached to the 3-D net 8 on opposite sides thereof. The anchor plates 20 are disposed at regular intervals on each side of the cushion C2 and are sandwiched at intermediate portions thereof between a resinous frame 12 and the side portion of the 3-D net 8. The resinous frame 12 together with the anchor plates 20 is joined to the 3-D net 8 by vibration welding.

Each anchor plate 20 has a generally rectangular recess 20*a* formed on each side thereof to enhance the joining strength thereof to the resinous frame 12. Each anchor plate 20 also has an inwardly extending engaging portion 20*b* formed on the 3-D net side.

Figure 18:
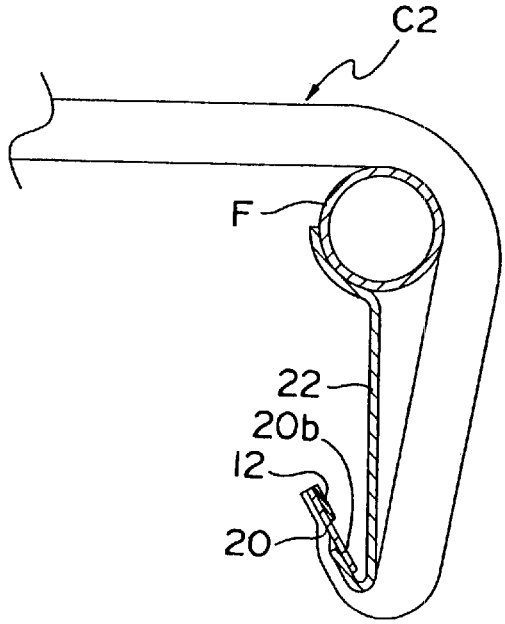
FIG. 18 is a sectional view of a seat frame to which hooks for fastening the cushion of FIG. 15 have been attached.
Figure 19:
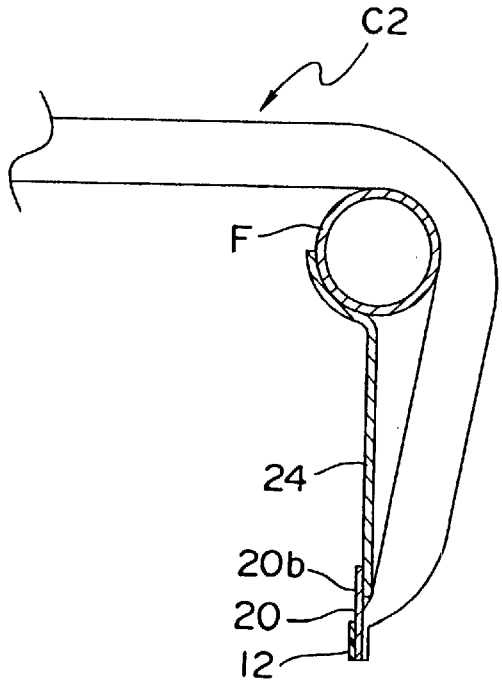
FIG. 19 is a view similar to FIG. 18, but depicting another seat frame.

As shown in FIGS. 18 and 19, the cushion C2 is fixed to and held on a frame F of a vehicle body by engaging the engaging portions 20*b* of the anchor plates 20 with a projection 22 or 24 formed on or secured to the frame F.

It is to be noted that although in the above-described embodiments the hooks 10 or 10A or the anchor plates 20 have been described as being located on opposite sides of the 3-D. net 8, they may be located on other sides in addition to such opposite sides of the 3-D. net 8.

Because the cushion C, C1, C2 according to the present invention employing the three-dimensional mesh knit as the 3-D net includes honeycomb-shaped upper and lower mesh layers 2, 4 and a large number of piles 6 each made of a single thick string, and is of a truss structure, it has the following advantages.

(1) Because each pile is elastic, the hardness, elasticity or fitness of the cushion can be controlled by changing the quality of the material, fiber thickness, texture or physical characteristics thereof.

(2) By making use of the shape memory function of the honeycomb shape, restoring capability and resistance to deformation can both be enhanced.

(3) The truss structure makes it possible to provide a thin and hard-to-deform elastic structure having good pressure dispersing and moderating capabilities, and improved fitness.

(4) Because the cushion is of a uniform honeycomb-shaped truss structure in which each part is independent, it is excellent in body pressure dispersion (low and uniform body pressure distribution) and can accommodate physical differences. For thin and fleshness men, the cushion can prevent a frontward slip thereof by concentrating, at low pressures, the body pressure on the tuber ischiadicum that is relatively insensitive to fatigue. Also, the cushion is excellent in weight movement and easy to change in terms of attitude, and reduces frictional shear force.

(5) The honeycomb-shaped truss structure does not bring about a state similar to a hammock (the state in which pressures are locally concentrated and strong side pressures are received), enables a user to take a natural attitude, and reduces a feeling of foreign substances by the effect of the elastic honeycomb structure.

(6) An air layer is formed inside the honeycomb-shaped truss structure to enhance moisture permeability and air permeability.

(7) The honeycomb-shaped truss structure enlarges the area where the body of a cushion occupant is held in contact with and supported by the cushion. Although the honeycomb-shaped truss structure provides an area contact or support as a whole, it locally provides a line contact or support, resulting in a non-sweaty structure.

(8) Without any skin or pad, the frame configuration and the thin high-elasticity member reduces the feeling foreign substances.

(9) The honeycomb-shaped truss structure increases the strength of the cushion.

Because the cushion having the 3-D net has the above-described advantages, seats employing this cushion can prevent a hemokinetic disorder up to the femurs, nervous disorders, a lumbar disorder or the like, optimize perspiration or skin temperature, and protect muscular tissue.

Although the present invention has been fully described by way of examples with reference to the accompanying drawings, it is to be noted here that various changes and modifications will be apparent to those skilled in the art. Therefore, unless such changes and modifications otherwise depart from the spirit and scope of the present invention, they should be construed as being included therein.

What is claimed is:

1. A cushion comprising:

a three-dimensional net;

fastening members attached to said three-dimensional net along opposite sides of said three-dimensional net; and two frame members attached to the opposite sides of said three-dimensional net, respectively, such that said fastening members are sandwiched between said two frame members and said three-dimensional net.

2. The cushion according to claim 1, wherein said fastening members and said two frame members are vibration welded to said three-dimensional net.

3. The cushion according to claim 2, wherein said fastening members comprise metallic fastening members.

4. The cushion according to claim 3, wherein said two frame members comprise two resinous frame members.

5. The cushion according to claim 4, wherein each of said metallic fastening members has a recess in each side edge thereof, and said metallic fastening members and said two resinous frame members are vibration welded to said three-dimensional net at said recesses.

6. The cushion according to claim 5, wherein each of said metallic fastening members has plural projections extending along each of said recesses, with at least one of said plural projections extending at a right angle relative to a corresponding each of said recesses.

7. The cushion according to claim 6, further comprising at least one belt attached to said three dimensional net.

8. The cushion according to claim 7, wherein said at least one belt is attached to said three dimensional net by having ends of said at least one belt attached to said three dimensional net.

9. The cushion according to claim 4, further comprising at least one belt attached to said three dimensional net.

10. The cushion according to claim 9, wherein said at least one belt is attached to said three dimensional net by having ends of said at least one belt attached to said three dimensional net.

11. The cushion according to claim 4, wherein said three-dimensional net comprises a three-dimensional mesh knit fabric.

12. The cushion according to claim 11, wherein each of said metallic fastening members has a recess in each side edge thereof, and said metallic fastening members and said two resinous frame members are vibration welded to mesh knit fabric at said recesses.

13. The cushion according to claim 12, wherein each of said metallic fastening members has plural projections extending along each of said recesses, with at least one of said plural projections extending at a right angle relative to a corresponding each of said recesses.

14. The cushion according to claim 11, further comprising at least one belt attached to said three dimensional mesh knit fabric.

15. The cushion according to claim 14, wherein said at least one belt is attached to said three dimensional mesh knit fabric by having ends of said at least one belt attached to said three dimensional mesh knit fabric.

16. The cushion according to claim 1, wherein said fastening members comprise metallic fastening members.

17. The cushion according to claim 1, wherein said two frame members comprise two resinous frame members.

18. The cushion according to claim 1, wherein each of said fastening members has a recess in each side edge thereof, and said fastening members and said two frame members are vibration welded to said three-dimensional net at said recesses.

19. The cushion according to claim 1, wherein each of said fastening members has plural projections extending along each of said recesses, with at least one of said plural projections extending at a right angle relative to a corresponding each of said recesses.

20. The cushion according to claim 1, further comprising at least one belt attached to said three dimensional net.

21. The cushion according to claim 20, wherein said at least one belt is attached to said three dimensional net by having ends of said at least one belt attached to said three dimensional net.

* * * * *